US006296738B1

(12) United States Patent
Ishii

(10) Patent No.: US 6,296,738 B1
(45) Date of Patent: Oct. 2, 2001

(54) SHOE PRESS BELT

(75) Inventor: Tsutomu Ishii, Chiba-Ken (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/670,980

(22) Filed: Sep. 27, 2000

(30) Foreign Application Priority Data

Sep. 29, 1999 (JP) ..... 11-275943

(51) Int. Cl.[7] ..... D21F 3/02
(52) U.S. Cl. ..... 162/358.4; 428/182; 162/901
(58) Field of Search ..... 162/358.3, 358.4, 162/358.5, 359.1, 360.2, 901, 358.1, 358.2; 428/167, 182; 492/30, 35, 36

(56) References Cited

U.S. PATENT DOCUMENTS 3,600,779 * 8/1971 DeNoyer ..... 492/33
5,543,015 * 8/1996 Jermo ..... 162/358.4
5,626,723 * 5/1997 Schiel et al. ..... 162/358.4

FOREIGN PATENT DOCUMENTS 36960 11/1989 (JP) ..... D21F/3/00
510594 10/1998 (JP) ..... D21F/7/08

* cited by examiner

*Primary Examiner*—Peter Chin
*Assistant Examiner*—Eric Hug
(74) *Attorney, Agent, or Firm*—Duane, Morris & Hecksche LLP

(57) ABSTRACT

A shoe press belt for use between a press roll and a shoe for pressing water from a wet sheet, formed with one or more grooves on the surface thereof for draining water, wherein the groove defines a plurality of laterally spaced channels, the channels having outwardly curved side walls and may include a rounded bottom. The shoe press belt has an improved groove configuration which retains water drainage capacity under nip pressure, while at the same time being resistant to crack formation, thereby enabling a satisfactory service life and avoiding the formation of 'groove-marks' on the pressed sheet. The press belt is simple in design and thus inexpensive to manufacture.

3 Claims, 5 Drawing Sheets

SHOE PRESS BELT

FIELD OF THE INVENTION

The present invention relates to shoe press belts for use in paper-making machines and other like machinery, and more particularly to an improved groove configuration for such press belts.

DESCRIPTION OF THE RELATED ART

Press belts are used in various press devices, such as shoe-type presses, as used in the papermaking industry to transport a continuous sheet of paper through a press nip. Press belts used in the paper making art typically include a series of circumferential, spaced-apart grooves which provide channels to transport water away from the sheets as they are being pressed.

The efficiency at which satisfactory sheets can be pressed is limited by the ability of the press belt channels to carry water away from the sheet being pressed. Over the past several years, in attempts to increase productivity, several groove configurations have been introduced. However, none of these configurations have proved particularly successful.

One such groove configuration is disclosed in unexamined Japanese Patent Publication No. 501594/1998, in which the groove, as viewed in cross-section, includes a curved bottom and spaced diverging side walls, which have an angle of divergence between 6 and 15 degrees. Another known groove configuration is disclosed in Japanese Utility Model Publication No. 36960/1989, which comprises a flat bottom and opposite diverging side walls (see FIGS. 1 and 2). Be that as it may, more commonly used press belts have grooves formed in a rectangular cross-section, in order to simplify machining, reduce production costs and increase productivity. There are, however, significant drawbacks associated with the use of square groove configurations in shoe press belts. For example, in a conventional shoe press belt wherein grooves are formed on the surface of the belt with a rectangular cross-section as shown in FIG. 3(*a*), the grooves have a tendency to deform as shown in FIGS. 3(*b*)–(*e*). More particularly, as the nip pressure increases from 500 KN/m to 1000 KN/m, 1500 KN/m and 2000 KN/m, the upper end portions of square grooves become narrower as if closing the entrance, the side walls bulge inward, and the bottom becomes convex. This deformation significantly reduces the cross-sectional area of the grooves, and consequently their capacity to drain water from the pressed sheet. It is known if the water draining function of the grooves deteriorates, so-called 'groove-marks' may appear on the pressed sheets.

Another problem associated with the use of square groove configurations is that sharp corners are likely to be formed under nip pressure at the juncture between the lower edge of the side walls and the bulging bottom of the grooves. These sharp corners create points of stress concentration which may lead to cracks.

Recent attempts to reduce the amount of groove deformation include the use of harder resins in manufacturing press belts. While press belts formed of harder resins are more resistant to groove deformation, they are more susceptible to crack formation and/or delamination, thus shortening the service life of the belts.

Therefore, it is the object of the present invention to provide a press belt having an improved, groove configuration which retains water drainage capacity under nip pressure, while at the same time being resistant to crack formation, thereby enabling a satisfactory service life and avoiding the formation of 'groove-marks' on the pressed sheet. The ideal press belt design would also be simple and hence cost effective to manufacture.

SUMMARY OF THE INVENTION

The above objects are accomplished by providing a shoe press belt formed with at least one groove on the outer surface thereof for draining water, wherein the at least one groove comprises side walls having concave inwardly facing surfaces. The grooves may be helically formed or they may include a plurality of spaced apart longitudinal grooves formed in parallel.

In one embodiment of the invention each of the grooves has a flat bottom and rounded corners smoothly joining the side walls.

In another embodiment of the invention, each of the grooves has a concave inwardly facing bottom and rounded corners smoothly joining the side walls.

Further, the present invention provides a shoe press belt, wherein the upper edges of the side walls are convexly rounded to smoothly join with the surface of the press belt.

BRIEF DESCRIPTION OF THE DRAWINGS

These and other objects, advantages and novel features of the invention will become more apparent from the following detailed description of the invention when considered in conjunction with the accompanying drawings wherein.

DETAILED DESCRIPTION OF THE INVENTION

Figure 1:
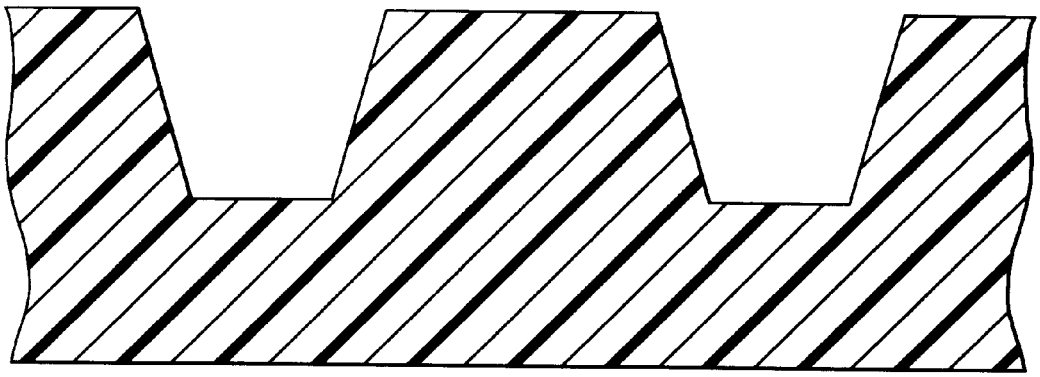
FIG. 1 (PRIOR ART)
FIG. 1 is an enlarged cross-sectional view of a conventional trapezoidal cross-section groove formed on a shoe press belt.
Figure 2:
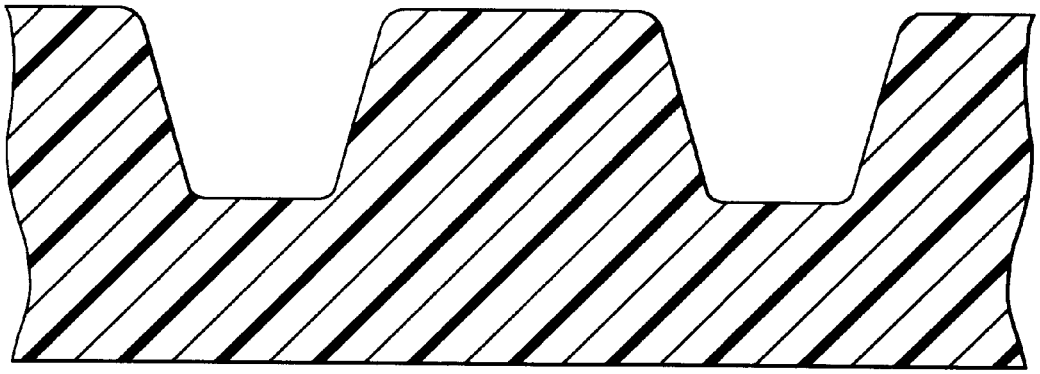
FIG. 2 (PRIOR ART)
FIG. 2 is an enlarged cross-sectional view of the conventional trapezoidal cross-section groove formed on a shoe press belt, as shown in FIG. 1, with rounded transition points.
Figure 3A:
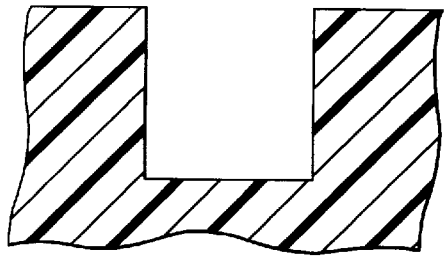
FIG. 3a (PRIOR ART)
FIGS. 3(*a*)–(*e*) are enlarged cross-sectional views of the deforming process of a conventional groove, under the pressure of a nip.
Figure 3B:
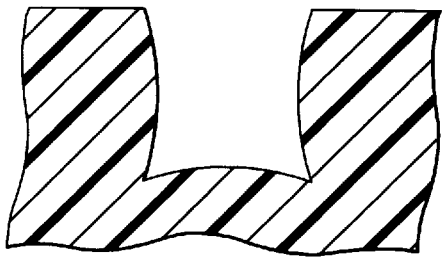
FIG. 3b (PRIOR ART)
Figure 3C:
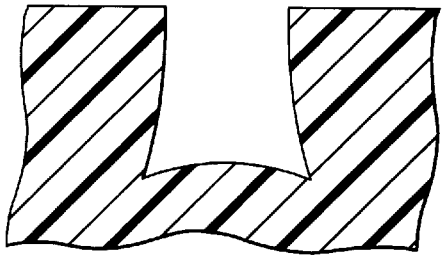
FIG. 3c (PRIOR ART)
Figure 3D:
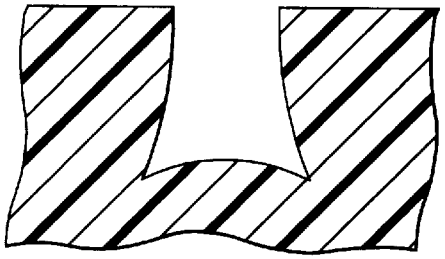
FIG. 3d (PRIOR ART)
Figure 3E:
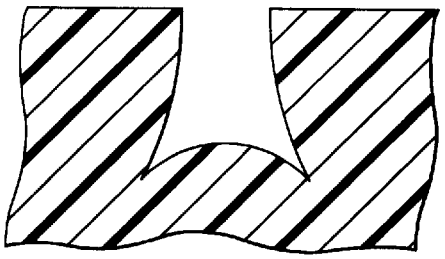
FIG. 3e (PRIOR ART)
Figure 4:
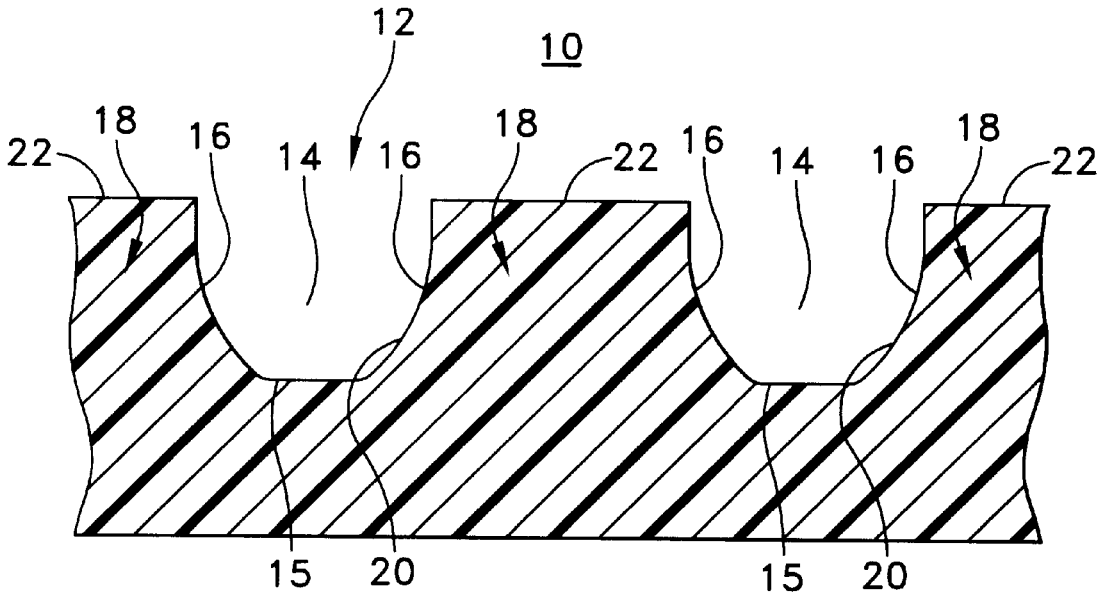
FIG. 4 is an enlarged cross-sectional view of an embodiment of a groove formed on a shoe press belt according to the present invention.

FIG. 4 shows a partial cross-sectional view of an emobodiment of a shoe press belt 10 having a groove 12 formed in accordance with the invention. The belt 10 may include one or more helical grooves, formed at an angle to the edges of the belt 10, and/or more longitudinal grooves, formed in parallel to the edges of the belt 10. In the embodiment shown, the groove 12 defines a series of parallel spaced apart channels 14, each of which includes a flat bottom 15 and outwardly curved, or concave, diverging side walls 16.

The channels 14 are separated by a series of tapered lands 18, which have a tapering width from base 20 to the top 22.

Press belts are typically formed with a thickness between about 3–6 mm. Channels 14 are generally 0.5 to 1 mm wide with the lands 18 being 2–5 times the width of the channel 14. In accordance with the embodiment shown, a specially formed cutter is needed to generate the desired curvature of the side walls 16.

Figure 5:
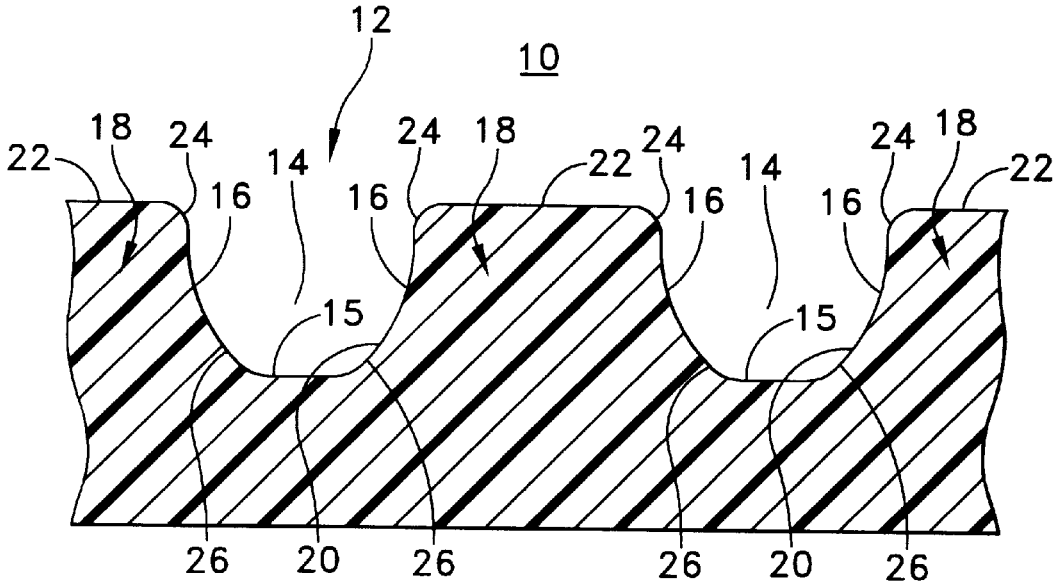
FIG. 5 is an enlarged cross-sectional view of another embodiment of a groove formed on a shoe press belt according to the present invention.
Figure 6:
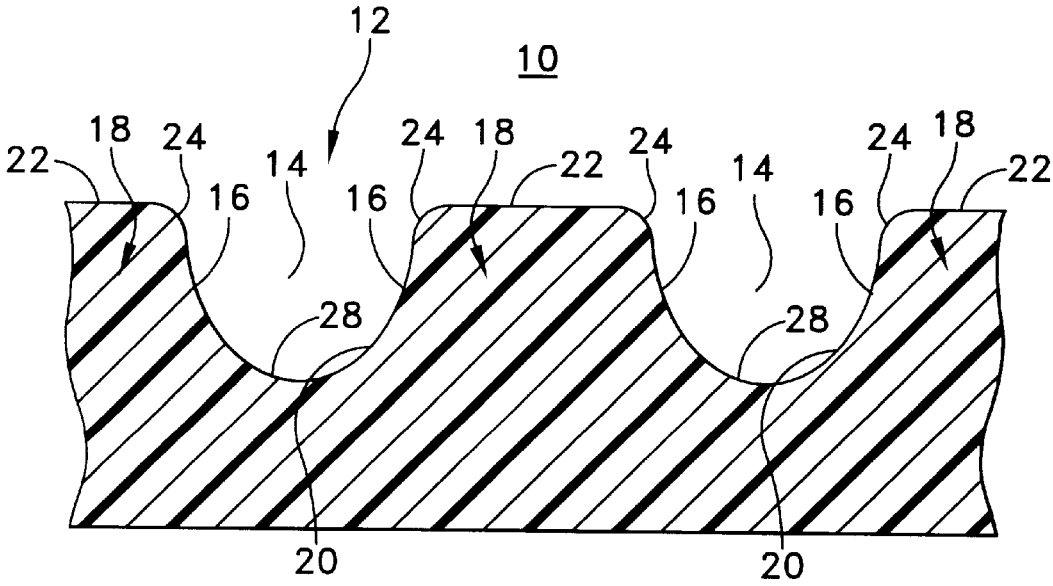
FIG. 6 is an enlarged cross-sectional view of another embodiment of a groove formed on a shoe press belt according to the present invention.
Figure 7A:
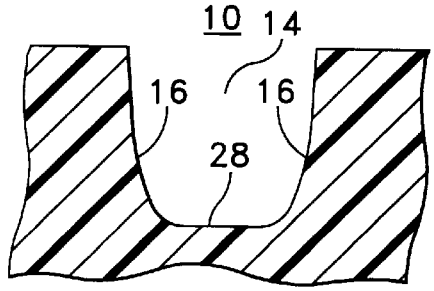
FIGS. 7 (*a*)–(*e*) are enlarged cross-sectional views of the defoming process of a groove formed in accordance with the present invention, under the pressure of a nip.
Figure 7B:
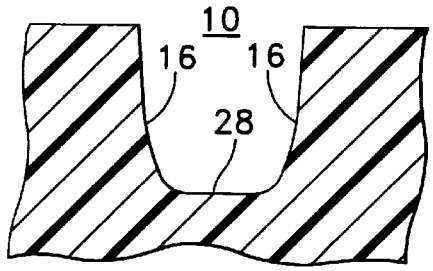
Figure 7C:
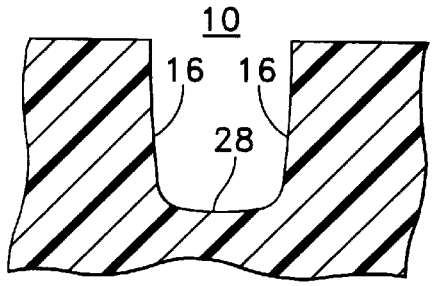
Figure 7D:
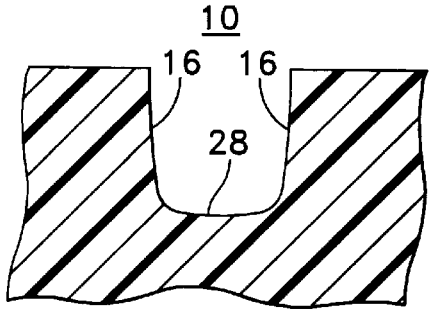
Figure 7E:
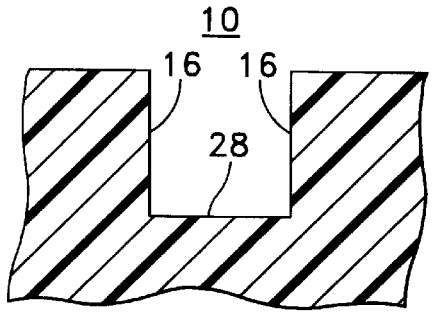

FIG. 5. shows another embodiment of the invention, which includes all of the features illustrated in FIG. 4 and is further provided with radiused top corners 24 of lands 18. In addition, the juncture 26 between the bottom 14 and each of the side walls 16 is rounded to provide a smooth transition between respective surfaces. In the embodiment shown in FIG. 6, a concavely rounded bottom 28 is additionally provided, thereby defining a channel having a single continuous arcuate surface.

FIG. 7(*a*) shows a partial cross-section of a shoe press belt 10 having channels 14 in accordance with an exemplary embodiment of the invention. The channels 14 are formed having concavely arcuate side walls 16 and smoothed corners 26 between the side walls 16 and the rounded bottom 28. The channels 14 have a tendency to deform as shown in FIGS. 7(*b*)–(*e*). More particularly, as the nip 'pressure increases from 500 KN/m to 1000 KN/m, 1500 KN/m and 2000 KN/m, the side walls 16 and the rounded bottom 28 gradually turn into flat shapes so as to have a rectangular cross-section, wherein the water pressed from the sheet can be discharged efficiently.

Experimental data collected by the inventor has demonstrated that water can be drained more effectively, if the bottom profile of the channel is also curved. Moreover, according to the invention, the bottom edges are not likely to become sharp as is the case with a conventional groove configuration, which can avoid stress concentration. Consequently, cracking of the belt may be reduced, and therefore can make the belt more durable.

In the shoe press belt 10 having concave, inwardly facing side walls 16, the channels 14 have a rectangular cross-section under nip pressure to effectively drain water pressed from the sheet. Thus, the occurrence of markings on the pressed sheet which may otherwise result from inadequate water drainage, are avoided.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A shoe press belt having at least one groove formed on the surface thereof for draining water, wherein the at least one groove comprises side walls with concave inwardly facing surfaces and at least one of a flat bottom and rounded corners smoothly joining with the side walls.

2. The shoe press belt of claim 1, wherein the upper edges of the side walls are convexly rounded to smoothly join with the surface of the press belt.

3. A continous loop shoe press belt having a helical groove formed on a surface thereof, the helical groove defining a series of laterally spaced circumferential channels, wherein the channels comprise side walls having concave inwardly facing surfaces and, wherein the channels have at least one of a flat bottom and rounded corners smoothly joining the bottom with the side walls.

* * * * *